US005924841A

United States Patent [19]

Okamura et al.

[11] Patent Number: 5,924,841

[45] Date of Patent: Jul. 20, 1999

[54] TURBO MOLECULAR PUMP

[75] Inventors: Tomoaki Okamura; Sadayuki Kotoura, both of Hiroshima, Japan

[73] Assignee: Mitsubishi Heavy Industries, Ltd., Tokyo, Japan

[21] Appl. No.: 08/963,014

[22] Filed: Nov. 3, 1997

[51] Int. Cl.[6] ..... F01D 1/36

[52] U.S. Cl. ..... 415/90; 415/176; 415/178; 417/423.4

[58] Field of Search ..... 415/90, 176, 177, 415/178; 417/423.4

[56] References Cited

U.S. PATENT DOCUMENTS 4,904,155 2/1990 Nagaoka et al. ..... 415/90
5,618,167 4/1997 Hirakawa et al. ..... 415/90

FOREIGN PATENT DOCUMENTS 612794 2/1994 Japan .
7-227940 9/1995 Japan .

*Primary Examiner*—F. Daniel Lopez
*Assistant Examiner*—Richard Woo
*Attorney, Agent, or Firm*—Michael D. Rechtin; Foley & Lardner

[57] ABSTRACT

A turbo molecular pump comprising a plurality of moving blades and stationary blades arranged alternately in the axial direction in a pump casing having a gas suction port and exhaust port, a thread groove pump stage disposed on the exhaust side of the moving and stationary blades, and a spacer for fixing the position intervals of the stationary blades, characterized in that a heating apparatus includes a radiating plate is provided in a gas passage of the thread groove pump stage, and the radiating plate is connected to a heating portion located on the outside of the pump by a good heat conductor. The heating apparatus heats the gas in the thread groove pump stage to a temperature above the gas sublimation temperature.

3 Claims, 3 Drawing Sheets

TURBO MOLECULAR PUMP

FIELD OF THE INVENTION AND RELATED ART STATEMENT

The present invention relates to a turbo molecular pump which evacuates the gas introduced through a suction port to an exhaust port by a plurality of moving blades (rotating blades) and stationary blades (fixed blades) arranged alternately in the axial direction and a thread groove pump stage.

FIG. 2 is a longitudinal sectional view of a conventional turbo molecular pump. A casing 1 (pump body) is provided with a gas suction port 2 and an exhaust port 3. Between the suction port 2 and the exhaust port 3, stationary blades (fixed blades) 4 are disposed so that the positions thereof are fixed by a spacer 19.

A rotor 6 is provided with moving blades (rotating blades) 5 and a thread groove pump stage 9. The rotor 6 is rotated by a rotating shaft 7. The moving blades 5 and the stationary blades 4 are arranged alternately in the axial direction.

A stator 8 is disposed around the rotating shaft 7, and an upper magnetic bearing 10, lower magnetic bearing 11, magnetic bearing 12 serving as an axial bearing, and a motor 13 are provided between the rotating shaft 7 and the stator 8 to rotate the rotor 6 at a high speed.

A heating portion 15 located on the outside of the casing 1 is heated by an electric heater 14, and transmits heat to a bulkhead 16 consisting of a heat transfer body via a good heat conductor 17.

A spacer 18 is interposed between the heating portion 15 and the casing 1. The bulkhead 16, which forms a gas passage in the vicinity of a gas outlet provided at the lower part of the casing 1, is thermally isolated from the casing 1 and the stator 8.

The casing 1 is provided with a cooling passage 22 for cooling the casing 1. The casing 1 is cooled by cooling water passing through the cooling passage 22, whereby the temperature of the rotor 6 made of an aluminum alloy material is kept below an allowable temperature.

In the aforementioned turbo molecular pump, when the rotor 6 having the moving blades 5 and the rotating shaft 7 is rotated at a high speed by the motor 13, the gas introduced through the suction port 2 flows toward the exhaust port 3 through a gas passage of the moving blades 5, the stationary blades 4, and the thread groove pump stage 9 and the gas passage in the bulkhead 16, so that the suction port 2 becomes a high vacuum and the exhaust port 3 becomes a low vacuum.

At this time, the heating portion 15 is heated by heating means such as an electric heater 14, and the heat of the heating portion 15 is transmitted to the bulkhead 16 consisting of a heat transfer body via the good heat conductor 17 to heat the bulkhead 16. Thereby, the temperature of gas in the vicinity of the bulkhead 16 is increased to prevent the adhesion of solidified matters.

In the conventional turbo molecular pump, when gas is exhausted, the rotating body becomes hot due to heat generation in the pump, so that creeping and reduced strength of aluminum alloy material used for the rotating body are caused. To solve this problem, the conventional turbo molecular pump is designed so that the casing (pump body) 1 is cooled by cooling means such as cooling water.

However, the cooling of the casing 1 decreases the temperature in the casing 1 to a value lower than the sublimation temperature of gas being exhausted, so that solidified matters adhere to the inside of gas passage, resulting in deteriorated pump performance, failures due to contact, and so on. In the conventional turbo molecular pump, therefore, the bulkhead 16 is provided in the gas passage in the vicinity of the gas outlet, and the bulkhead 16 is heated by the heating means such as the electric heater to increase the temperature of gas in the vicinity of the bulkhead 16 to a value higher than the solidification temperature. However, solidified matters adhere to the portion in the vicinity of the thread groove pump stage 9, which does not reach the heating temperature sufficiently.

For this reason, maintenance work for regularly removing solidified matters is needed, so that the rate of pump operation decreases.

OBJECT AND SUMMARY OF THE INVENTION

The present invention was made to solve the above problem with the prior art, and accordingly an object thereof is to provide a turbo molecular pump in which a radiating plate is disposed in a gas passage of thread groove pump stage, whereby the gas temperature is increased to a value above the sublimation temperature to prevent the adhesion of solidified matters and to eliminate the need for maintenance work such as cleaning of the interior of a casing.

To achieve the above object, the present invention provides a turbo molecular pump comprising a plurality of moving blades and stationary blades arranged alternately in the axial direction in a pump casing having a gas suction port and exhaust port, a thread groove pump stage disposed on the exhaust side of the moving and stationary blades, and a spacer for fixing the position intervals of the stationary blades, characterized in that a radiating plate is provided in a gas passage of the thread groove pump stage, and the radiating plate is connected to a heating portion located on the outside of the pump by a good heat conductor, and also a heat shied plate is provided between the outer periphery of the radiating plate and the spacer.

According to the present invention, in a turbo molecular pump comprising a plurality of moving blades and stationary blades arranged alternately in the axial direction in a pump casing having a gas suction port and exhaust port, a thread groove pump stage disposed on the exhaust side of the moving and stationary blades, and a spacer for fixing the position intervals of the stationary blades, a radiating plate is provided in a gas passage of the thread groove pump stage, and the radiating plate is connected to a heating portion located on the outside of the pump by a good heat conductor. Therefore, the radiating plate increases the gas temperature in the gas passage of thread groove pump stage to a value above the sublimation temperature, whereby the adhesion of solidified matters is prevented, the need for maintenance work such as cleaning of the interior of the casing is eliminated, and continuous operation is made possible. Therefore, the turbo molecular pump in accordance with the present invention achieves an effect of further increasing the rate of pump operation, so that it is very useful for industrial applications.

Further, according to the present invention, the radiating plate is provided independently of the spacer which is used as a heat transfer path for cooling the rotor, and the heat shield plate is provided between the outer periphery of the radiating plate and the spacer. Therefore, the temperature of the gas passage only can be increased without increasing the temperature of the whole rotor.

Thereupon, the solidification and adhesion of process gas can be prevented without creeping and reduced strength of the rotating body.

DETAILED DESCRIPTION OF PREFERRED EMBODIMENTS

One embodiment of a turbo molecular pump of the present invention will be described in detail with reference to FIG. 1.

Figure 2:
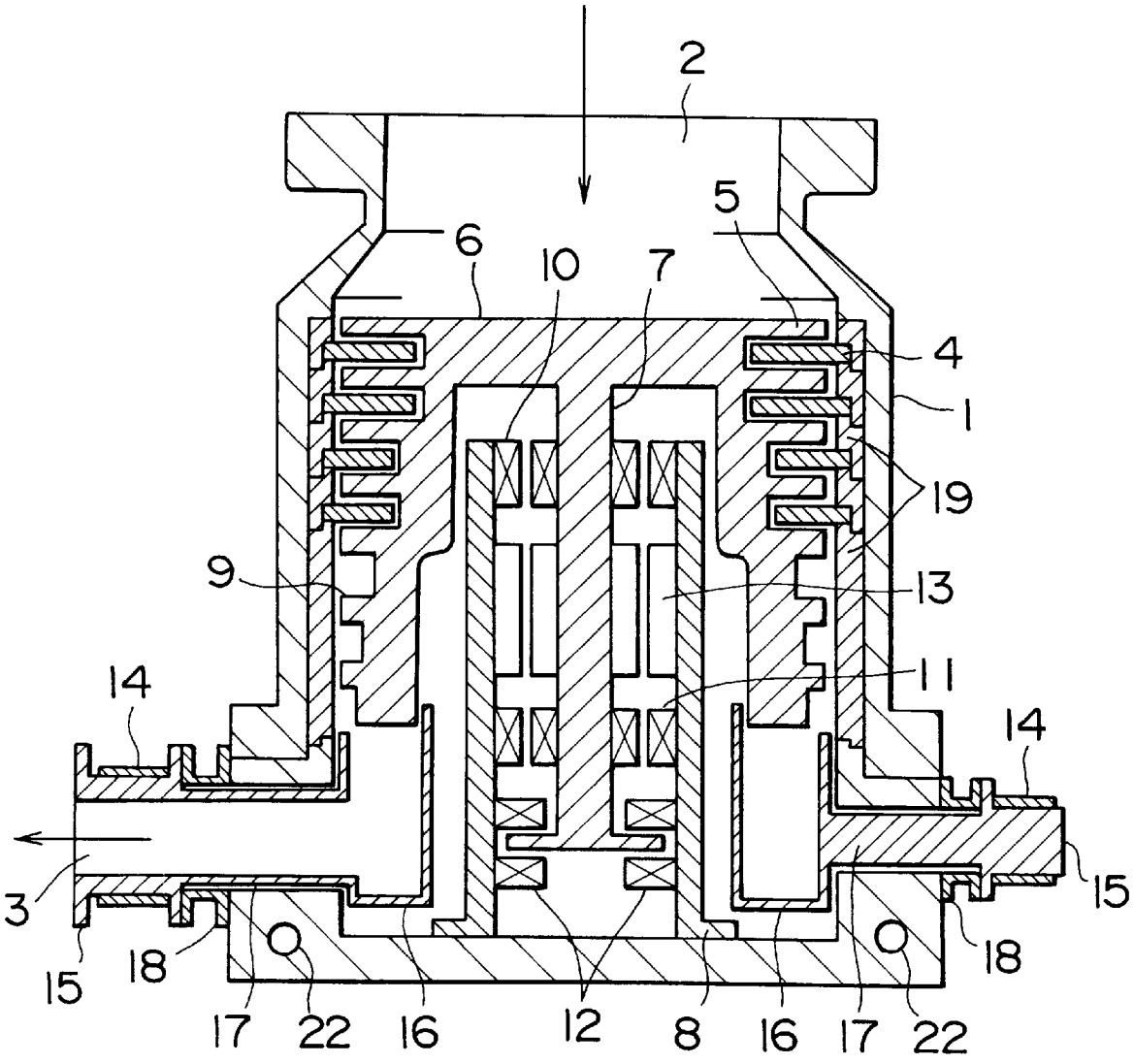
FIG. 2 RELATED ART
FIG. 2 is a longitudinal sectional view of a conventional turbo molecular pump.

The same reference numerals are applied to elements which are the same as those of the conventional pump shown in FIG. 2.

Figure 1:
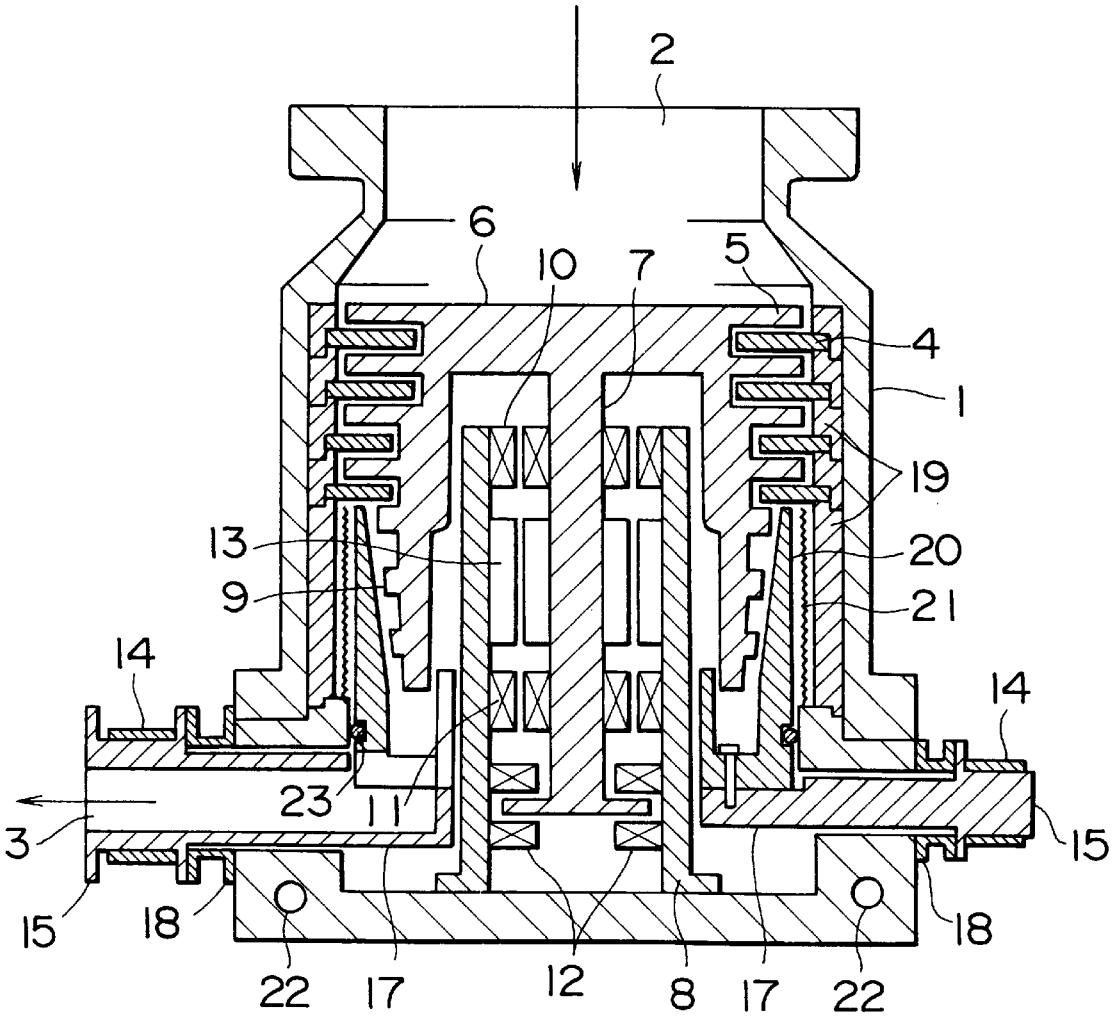
FIG. 1 is a longitudinal sectional view of a turbo molecular pump in accordance with one embodiment of the present invention.

In FIG. 1, reference numeral 1 denotes a casing (pump body), 2 denotes a suction port provided at the upper part of the casing 1, 3 denotes an exhaust port provided at the lower side part of the casing 1, and 4 denotes a plurality of stationary blades (fixed blades) provided in the casing 1 at intervals in the axial direction. The stationary blades 4 are arranged so that the positions thereof are fixed by a spacer 19.

Reference numeral 6 denotes a rotor disposed in the casing 1, 7 denotes a rotating shaft of the rotor 6, and 5 denotes a plurality of moving blades (rotating blades) attached to the outer periphery of the rotor 6 at intervals in the axial direction. The moving blades 5 and the aforesaid stationary blades 4 are arranged alternately in the axial direction.

Reference numeral 8 denotes a stator disposed around the rotating shaft 7. Between the stator 8 and the rotating shaft 7, a magnetic bearing 10 disposed as an upper bearing, a magnetic bearing 11 disposed as a lower bearing, a magnetic bearing 12 disposed as an axial bearing, and a motor 13 are provided.

Reference numeral 15 denotes a heating portion located on the outside of the casing 1. The heating portion 15 is heated by heating means such as an electric heater 14 provided at the outer periphery of heating portion.

The aforesaid spacer 19 fixes the installation positions of the stationery blades 4 in the axial direction. Reference numeral 20 denotes a radiating plate provided in a gas passage between a thread groove pump stage 9 and the spacer 19. The space between the outer periphery of the radiating plate 20 and the inner periphery of the casing 1 is sealed by an O-ring 23 to prevent the bypassing of gas.

Reference numeral 21 denotes a heat shield plate provided between the outer periphery of the radiating plate 20 and the spacer 19 inside the casing 1. The heat shield plate 21 shields the radiation heat from the radiating plate 20 to prevent the heat from being transmitted to the spacer 19.

Reference numeral 17 denotes a good heat conductor for transmitting the heat from the heating portion 15 to the radiating plate 20. The heating portion 15 and the radiating plate 20 are connected to each other via the good heat conductor 17. Reference numeral 18 denotes a heat insulating spacer interposed between the heating portion 15 and the casing 1. The casing 1 is thermally isolated from the heating portion 15, the good heat conductor 17, and the radiating plate 20 by the spacer 18.

Reference numeral 22 denotes a cooling passage provided at the lower part of the casing 1. The casing 1 is cooled by cooling means such as water cooling which allows cooling water to flow in the cooling passage 22, so that the temperature of the rotating body (rotor 6) made of an aluminum alloy material is kept below an allowable temperature.

In the aforementioned turbo molecular pump, when the rotor 6 having the moving blades 5 and the rotating shaft 7 is rotated at a high speed by the motor 13, the gas introduced through the suction port 2 flows toward the exhaust port 3 through a gas passage of the moving blades 5, the stationary blades 4, and the thread groove pump stage 9 and is evacuated, so that the suction port 2 becomes a high vacuum and the exhaust port 3 becomes a low vacuum.

At this time, the heating portion 15 provided on the outside of the pump is heated by the electric heater 14, and the heat of the heating portion 15 is transmitted to the radiating plate 20 through the good heat conductor 17 in the pump to heat the radiating plate 20. Thereby, solidified matters are prevented from adhering to the thread groove pump stage 9, the rotating body, and the periphery thereof. The radiation temperature from the radiating plate 20 is controlled by the electric heater 14 for heating the heating portion 15 so as to be higher than the gas sublimation temperature to the extent that the strength of the rotating body etc. made of an aluminum alloy material is not affected by the temperature.

On the other hand, the heat generated by the rotor 6 is transmitted from the moving blades 5 to the stationary blades 4 to the spacer 19 to the casing 1, and cooled by the cooling water in the cooling passage 22, so that the temperature rise of the rotating body is kept below the allowable temperature.

Figure 3:
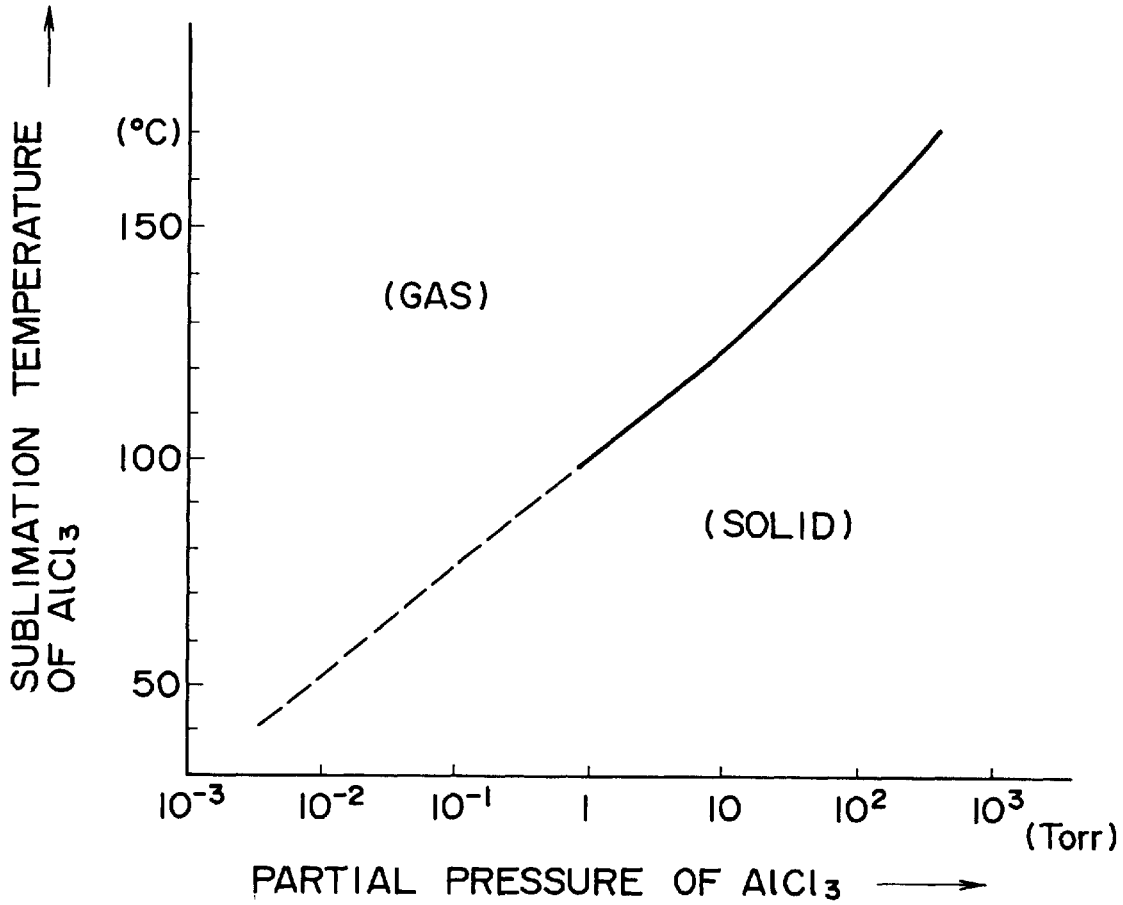
FIG. 3 is a graph showing the relationship between partial pressure and sublimation temperature of aluminum chloride ($AlCl_3$).

FIG. 3 is a graph for finding the sublimation temperature of aluminum chloride ($AlCl_3$), quoted from "the relationship between partial pressure and sublimation temperature of $AlCl_3$ in Chemistry Handbook". This figure indicates that the sublimation temperature increases with increasing gas pressure and the zone under the graph line is a solid zone.

In the aforementioned turbo molecular pump, the pressure of the gas introduced through the suction port 2 is gradually increased by passing through the moving blades 5, the stationary blades 4, and the thread groove pump stage 9, and exhausted through the exhaust port 3. The radiating plate 20 is disposed at the position where the gas pressure is increased and the sublimation temperature is increased according to the change in gas pressure, and the radiation temperature of the radiating plate 20 is set so as to be higher than the gas sublimation temperature.

As described above, in the present invention, the temperature of the gas passage is increased by the radiating plate 20 so as to be higher than the gas sublimation temperature to the extent that the strength of the rotating body etc. made of an aluminum alloy material is not affected by the temperature. Therefore, the present invention achieves an effect that solidified matters are prevented from adhering to the gas passage.

We claim:

1. A turbo molecular pump comprising a plurality of moving blades and stationary blades arranged alternately in an axial direction in a pump casing having a gas suction port and exhaust port, a thread groove pump stage disposed on an exhaust side of said moving and stationary blades, and a spacer for fixing the position intervals of said stationary blades, characterized in that a radiating plate is provided in a gas passage of said thread groove pump stage, and said radiating plate is connected to a heating portion located on the outside of said pump by a good heat conductor.

2. A turbo molecular pump according to claim (1), wherein a heat shield plate is provided between the outer periphery of said radiating plate and said spacer.

3. A turbo molecular pump according to claim (1), wherein a seal member is provided between an outer periphery of said radiating plate and an inner periphery of said casing.

* * * * *